US011779970B2

(12) United States Patent
Grabner et al.

(10) Patent No.: US 11,779,970 B2
(45) Date of Patent: Oct. 10, 2023

(54) DEVICE COMPRISING A HOUSING AND A ROTARY ELEMENT MOUNTED IN THE HOUSING SUCH THAT IT CAN BE ROTATED AND AXIALLY SHIFTED

(71) Applicant: Primetals Technologies Austria GmbH, Linz (AT)

(72) Inventors: Walter Grabner, Neuhofen an der Krems (AT); Friedrich Moser, Hellmonsoedt (AT)

(73) Assignee: PRIMETALS TECHNOLOGIES AUSTRIA GMBH

( * ) Notice: Subject to any disclaimer, the term of this patent is extended or adjusted under 35 U.S.C. 154(b) by 106 days.

(21) Appl. No.: 17/441,373

(22) PCT Filed: Mar. 16, 2020

(86) PCT No.: PCT/EP2020/057118
§ 371 (c)(1),
(2) Date: Sep. 21, 2021

(87) PCT Pub. No.: WO2020/187837
PCT Pub. Date: Sep. 24, 2020

(65) Prior Publication Data

US 2022/0184677 A1 Jun. 16, 2022

(30) Foreign Application Priority Data

Mar. 21, 2019 (EP) ..... 19164296

(51) Int. Cl.
*B21B 39/14* (2006.01)
*B21B 15/00* (2006.01)

(52) U.S. Cl.
CPC ..... *B21B 15/00* (2013.01); *B21B 39/14* (2013.01); *B21B 2015/0057* (2013.01)

(58) Field of Classification Search
CPC ..... B21B 39/02; B21B 39/008; B21B 39/10; B21B 39/084; B21B 39/04; B21B 39/14;
(Continued)

(56) References Cited

U.S. PATENT DOCUMENTS 2,818,954 A * 1/1958 Vice ..... B21B 39/14 119/422
2016/0214154 A1* 7/2016 Frauenhuber ..... B21B 39/14

FOREIGN PATENT DOCUMENTS

EP 2 853 315 A1 4/2015
EP 3 049 198 B1 6/2017
(Continued)

OTHER PUBLICATIONS

International Search Report dated Jun. 17, 2020 in corresponding PCT International Application No. PCT/EP2020/057118.
(Continued)

*Primary Examiner* — Bobby Yeonjin Kim
(74) *Attorney, Agent, or Firm* — OSTROLENK FABER LLP

(57) ABSTRACT

A device having a housing (2) and a rotary element (4) mounted in the housing (2) such that it can be rotated and axially shifted (14). In order to reduce bearing loads in the rotary element (4), with eccentric loading of the rotary element (4), the device provides at least one first support surface (6) on an end side (8) of the rotary element (4) and a second support surface (10) axially, opposite (40) the first support surface (6) on the housing (2). The rotary element (4) is then mounted in the housing (2) in such a way that, with the impact of an axial force (12) on the rotary element (4), the axial shiftability (14) of the rotary element (4) is limited by the support (16) of the first support surface (6) on the second support surface (10).

14 Claims, 2 Drawing Sheets

(58) Field of Classification Search
CPC ..... B21B 39/16; B21B 41/10; B21B 37/50; B21B 1/22
USPC ..... 72/250; 226/196.1
See application file for complete search history.

(56) References Cited

FOREIGN PATENT DOCUMENTS

| | | | |
|---|---|---|---|
| JP | S55-082115 | U | 6/1980 |
| JP | S62-34910 | U | 3/1987 |
| SU | 440176 | A1 | 8/1974 |
| SU | 816597 | A1 | 3/1981 |

OTHER PUBLICATIONS

Written Opinion dated Jun. 17, 2020 in corresponding PCT International Application No. PCT/EP2020/057118.
European Search Report dated Sep. 17, 2019 in corresponding European Patent Application No. 19164296.6.
Anonymous, "Eco Slide Disc Operation time extended by a factor of ten," Siemens Vai, Mar. 1, 2014, XP055478703, 2 pages.
Russian Federation Office Action and Search Report, dated Aug. 4, 2023, issued in corresponding Russian Patent Application No. 2021127474/05(058023), with attached English translation.

* cited by examiner

DEVICE COMPRISING A HOUSING AND A ROTARY ELEMENT MOUNTED IN THE HOUSING SUCH THAT IT CAN BE ROTATED AND AXIALLY SHIFTED

CROSS-REFERENCE TO RELATED APPLICATIONS

The present application is a 35 U.S.C. §§ 371 national phase conversion of PCT/EP2020/057118, filed Mar. 16, 2020, the contents of which are incorporated herein by reference, which claims priority of European Patent Application No. 19164296.6 filed Mar. 21, 2019, the contents of which are incorporated by reference herein. The PCT International Application was published in the German language.

The invention concerns a device with a housing and a rotary element mounted in the housing such that it can be rotated and axially shifted.

In the production of metal strips, the strips are conducted by means of metal strip conveyor devices, for example roller tables, to processing machines, for example coiler devices, where the strips are wound.

It is here necessary to subject the metal strips to lateral guidance. In particular, before the start of winding, this is necessary in order to keep the offset of the individual windings on the wound coil as small as possible so as to achieve an even side face of the wound coil.

Devices for lateral guidance are for example guide rules or gibs.

The above-mentioned device with housing and rotary element may be used, for example, as part of such a side guide or guide rule/gib in a roller table portion of a rolling mill, in particular at the coiler inlet of the coiler device in a hot strip mill, for secure lateral guidance of a rolled product or hot strip.

For example, a wearing element, here a wearing disc, is arranged at or on the rotary element. The rotary element and the wearing disc are rotatably arranged in a side guide of the roller table portion or in the guide rule/gib, whereby the rolled product or hot strip can be guided laterally by means of the wearing disc during transport over rolls of the roller table portion.

Such wearing discs, in the side guide of a hot strip at the coiler inlet of a hot strip mill, are known for example as "Eco Slide Discs" from the company Primetals Technologies.

In a hot strip mill equipped with such "Eco Slide Discs", or in the roller table known there, and at the coiler inlet, the coiler gibs of the hot wide strip mill are equipped with rotatable "Eco Slide Discs" which are attached to a maintenance-free, robust gear beam.

Because they are arranged on a rotatably mounted rotary element, these wearing discs, which are each arranged vertically at the side of the roller table rolls, may be or are rotated automatically and synchronously through a desired angle after a specifiable number of guided strips.

In contrast to the "fixed" wearing plates which are otherwise normally used, in which the strip cut always takes place at the same point of the wearing plate, the wear is evenly distributed over the complete ring face of the Eco Slide Disc. This extends the usage period of the wearing parts and hence the continuous operating time of the gibs from the previous few days up to several months (see also EP 3 049 198 B1).

Because of the cyclic rotation of the wearing discs or Eco Slide Discs, locally only small adhesions occur from strip edge abrasion, which can be ground down again by the following strips.

Because of this self-cleaning effect of the wearing discs or Eco Slide Discs, for specific strip qualities, the manual cleaning process necessary at the wearing strips in order to avoid strip surface defects from the dropping of adhering strip edge melt, may be omitted.

Previous results have shown that it is sufficient to rotate the wearing discs or Eco Slide Discs, or replace these with new wearing discs or Eco Slide Discs, on average after four to sixteen weeks of maintenance-free operation, as part of a scheduled repair shutdown. Otherwise, no repair welding and grinding work on the costly wear plates/strips is required.

It has furthermore been found that, during operation of such wearing discs or Eco Slide Discs, i.e. on guidance of the hot strip, high eccentric, i.e. with a radial distance from the rotational axis of the wearing disc/Eco Slide Disc axial forces, from the guided strip act on the wearing disc or Eco Slide Disc.

If these axial forces are introduced eccentrically, they also generate tilt moments at the same time as the axial load/force, whereby bearing intervals of bearings on the rotatably mounted wearing disc or Eco Slide Disc become correspondingly large, or the receivable axial loads are physically limited. Also, increased wear may occur at the bearings of the wearing disc/Eco Slide Disc.

Conventional bearing concepts for such wearing discs/Eco Slide Discs can only be used with restrictions in this case, or are subject to said disadvantages, in particular under the limited spatial conditions prevailing at the wearing discs.

SUMMARY OF THE INVENTION

It is an object of the invention to provide a device with a rotatably mounted rotary element which avoids the disadvantages of the prior art, and in particular is less disadvantageous, particularly for eccentrically acting axial forces.

This object is achieved by a device with a housing and a rotary element mounted in the housing such that it can be rotated and axially shifted.

Terms such as "axial" or "radial" should be understood in relation to a rotational axis of the rotary element mounted such that it can be rotated and axially shifted. Terms such as "horizontal" or "vertical" have the usual meanings.

The device with a housing and a rotary element mounted in the housing, such that the rotary element can be rotated and axially shifted, provides at least one first support face on an end face of the rotary element and a second support face axially opposite the first support face on the housing.

The rotary element, for example a shaft, is then mounted in the housing such that under the action of an axial force on the rotary element, such as a guide force on guidance of strips, the axial shiftability of the rotary element is limited by the contact of the first support face on the second support face.

The housing may also be and/or may comprise attachment elements, wherein the rotary element is mounted in the attachment elements. The housing may thus for example also be and/or comprise a guide carrier in which the rotary element is mounted.

A "support face" means a surface which is suitable and also provided for coming into a support contact with another correspondingly suitable and provided "support face".

An "end face" of the rotary element may here mean a face of the rotary element which is oriented substantially perpendicularly to the rotational axis of the rotary element, for example a side cheek on a shaft.

The device provides that the axial shiftability of the rotary element is or becomes limited by the axial play of the rotary element relative to the housing, which is achieved or permitted in the device by the axial distance between the first end-side support face on the rotary element and the second axially opposite support face on the housing "Play, is the freedom of movement created by production and use, in which a mechanical component is able to move freely during or after installation against another or with another component of the component group or functional unit.

"Other possible plays in components" inside the device, for example a bearing play of the rotary element or an engagement play of the rotary element with another component in engagement with the rotary element, are matched accordingly or are greater than the axial shiftability/axial play of the rotary element relative to the housing, so that the axial shiftability of the rotary element is or becomes limited by the axial play of the rotary element relative to the housing, which is achieved or permitted in the device as the axial distance between the first end-side support face on the rotary element and the second axially opposite support face on the housing.

If an axial load then acts on the rotary element, the rotary element can or does shift axially until the first support face on the rotary element contacts the second support face on the housing, whereby the first support face on the rotary element is supported on the second support face of the housing. The rotary element is thus supported, in particular with an axial support and/or a support against tilting.

Expressed otherwise because of the limitation of axial shiftability of the rotary element with its first support face by the housing second support face, the rotary element can be supported, under axial load and axial shift by its first end-side support face on the second, axially opposite housing-side support face.

This direct support of the rotary element via the support faces relieves the load on the bearing of the rotary element, with respect to axial load, e.g. a thrust bearing. Forces and moments are absorbed via the support.

In particular, loads acting eccentrically on the rotary element, as well as axial load, also lead to tilt moments in the rotary element and those loads would normally have to be absorbed by the bearing of the rotary element and thus produces an increased bearing load in the bearing of the rotary element. In the device hereof, bearing forces and/or bearing moments may thus be limited or reduced. In the device, the force is received/absorbed/dissipated by the direct support face contact.

In this way, the device also allows the implementation of conventional bearing concepts, with in particular bearings of smaller structure and/or smaller bearing support intervals.

The rotary element is a gear wheel or the combination of a shaft and a gear wheel arranged on the shaft. Where applicable, the shaft and gear wheel are configured integrally, or placed as a separate component on the shaft, of a mechanical gear, in particular of a form-fit or force-fit/friction-fit or electric gear, and/or is connected to a gear mechanism and/or is a component of a gear wheel of a mechanical gear.

For example, in the case of a worm gear, the rotary element may be a worm wheel. In this case, the housing would be a worm housing. The rotary element or the worm wheel would in this case stand in engagement with a worm and would be able to be turned thereby. The first support face could be a side cheek of the shaft and/or the worm wheel, for example in the radially outer region of the worm wheel or gear rim. The second support face would be a gear base of the worm gear housing.

It is furthermore also suitable to mount the rotary element in the housing by means of at least one bearing bush, where applicable here with unilateral mounting of the rotary element or with several bearing bushes. The axial bearing play in the bearing bush or bushes should be matched accordingly or set larger than the axial shiftability/axial play of the rotary element relative to the housing from the axial spacing of the two support faces, so that the axial shiftability of the rotary element is or becomes limited by the axial play of the rotary element relative to the housing. This is achieved or permitted in the device as the axial distance between the first end-side support face on the rotary element and the second axially opposite support face on the housing.

Such a bearing bush or bushes may then also have joints able to receive axial forces. These joints could then be or could be made substantially free from axial load by/in the device.

A wearing element, for example a disc, in particular a wearing disc, for example an Eco Slide Disc, is arranged on the rotary element. The wearing element is suitable for lateral guidance of a metal strip, for example in an apparatus for lateral guidance of a metal strip.

Such a wearing element or disc may also be attached to the rotary element as a separate and thus interchangeable component, for example bolted on via a centered seat. Also, such a disc may be configured integrally with the rotary element. In short, the rotary element, for example, a shaft or a gear wheel or shaft with gear wheel, and the disc are two parts or are made from one piece.

It may be provided that the rotary element is mounted in the housing, and/or the rotary element has a shape such that on a support contact between the first support face and the second support face, a planar contact is formed whereby the support can be improved. For example, the mounting of the rotary element could be configured such that the first support face and the second support face form mutually parallel flat faces.

The first support face may be formed to be substantially annular, for example in the radially outer region of a gear rim forming the rotary element. The circular planar contact, which thereby becomes possible, between the first and second support faces may further improve the support.

Also, the first support face may be formed to be substantially circular, in some cases with unilateral mounting of the rotary element, or to have a different surface form.

In a preferred refinement, the device is part of a gear arrangement. Then, for example, the rotary element may be both, integrally, a shaft and a gear wheel, on which a wearing disc, for example an Eco Slide Disc, is attached, in particular via a centering seat.

A further gear wheel may then be connected to the rotary element or gear wheel for motion transmission.

Such a gear arrangement with the device may be implemented for example as a toothed gear, such as a worm gear mechanism.

In a refinement, the device is installed in an apparatus for lateral guidance of a metal strip, also known as a side guide, such as a gib/guide rule, in particular a coiler gib, for a roller table portion in a rolling mill, in particular for a roller table portion at a coiler inlet of a hot strip mill.

In other words, the device and/or the apparatus in which the device is installed may in particular also be used for lateral guidance of a metal strip, in particular for a roller table portion of a rolling mill. For this, for example, the side guide may comprise a gear beam on which the device is attached. It is suitable if several devices are fitted in such a side guide or such a gear beam.

The device according to the invention is thus, for example, part of an apparatus for lateral guidance of a metal strip running for example over a metal strip conveyor device, for example a roller table portion of a rolling mill.

Thus, an apparatus for lateral guidance of a metal strip is provided, having at least one device with a housing (2) and a rotary element (4) mounted in the housing (2) such that it can be rotated and axially shifted (14), wherein the device with a housing (2) and a rotary element (4) mounted in the housing (2) such that it can be rotated and axially shifted (14) is configured as explained in the present description.

The device according to the invention is thus suitable for installation or fitting in an apparatus for lateral guidance of a metal strip running over a metal strip conveying device, for example a roller table portion of a rolling mill.

In an apparatus for lateral guidance of a metal strip, usually the available space is very limited. Thus for a rotary element, the possible bearing support intervals are also limited, since the installation space for the housing only has limited width. Accordingly, on the introduction into the housing of forces which are exerted on a wearing element on guidance of the metal strip, as shown for example in EP 2853315 A1, a problem arises that large guidance forces of, for example 60 to 80 kN, and, where applicable, resulting large tilt moments, have undesirable effects on the bearing of the rotary element, as described above. With the structure according to the invention, forces are introduced into the housing not only via bearings but mainly directly, and hence into the gear beam carrying the housing. Therefore, problems associated with force-loading of bearings and small bearing support intervals can be alleviated or avoided. Accordingly, the solution according to the invention makes it possible, under the restricted spatial conditions, to transmit the forces via the rotary element and overcome these problems.

To be able to perform the rotation of the rotary element, in particular a controlled rotation into several defined rotary positions, it is suitable here to also provide an adjustment means which is at least in force-fit connection with the rotary element, in particular, in the case of several fitted devices with all rotary elements, whereby on actuation of the adjustment means, the rotary element, and in particular all rotary elements, are rotatable simultaneously and/or in synchrony, in particular under control into the defined rotary positions.

If for example the device or devices is/are each part of a worm gear, i.e. the respective rotary element is here the worm wheel, the adjustment means may be a common worm which is in engagement with the worm wheel rotary element or worm wheels. By activation of the worm wheels or this one worm, in particular in the case of several devices/worm gears, all worm wheels can then be actuated simultaneously/in synchrony.

Furthermore, also a roller table portion in a rolling mill, in particular at a coiler inlet in a hot strip mill, may be provided with rolls transporting a rolled product, in particular a hot strip, in which this/these above-mentioned side guide(s) is/are fitted for lateral guidance of a rolled product, in particular a hot strip, transported by the rolls.

It may furthermore be suitable to reinforce the rotary element in the region of the first support face, for example by corresponding material thickenings.

Treating the first and/or second support face, for example by hardening, coating or similar may be provided.

The description of advantageous embodiments of the invention given above contains numerous features which are indicated in the individual subclaims, sometimes combined into groups. These features may however suitably also be considered individually and grouped into further suitable combinations. In particular, these features may each be used individually and grouped into arbitrary suitable combinations with the roll stand according to the invention.

Although in the description or claims, some concepts are used in the singular or in conjunction with a number, the scope of the invention with these terms is not restricted to the singular or to the number given. Furthermore, the words "one" or "a" should not be regarded as a number but as the indefinite article.

The properties, features and advantages of the invention described above, and the manner in which these are achieved, will become clearer and be more easily understood in connection with the following description of the exemplary embodiment(s) of the invention, which are explained in more detail in connection with the drawings. The exemplary embodiment(s) serves/serve to explain the invention and does/do not restrict the invention to the combinations of features given therein, also not in relation to functional features. In addition, suitable features of each exemplary embodiment may also be viewed explicitly in isolation separately from an exemplary embodiment, or introduced into another exemplary embodiment in order to complement this and combined with any of the claims.

DETAILED DESCRIPTION OF EMBODIMENTS

Figure 1:
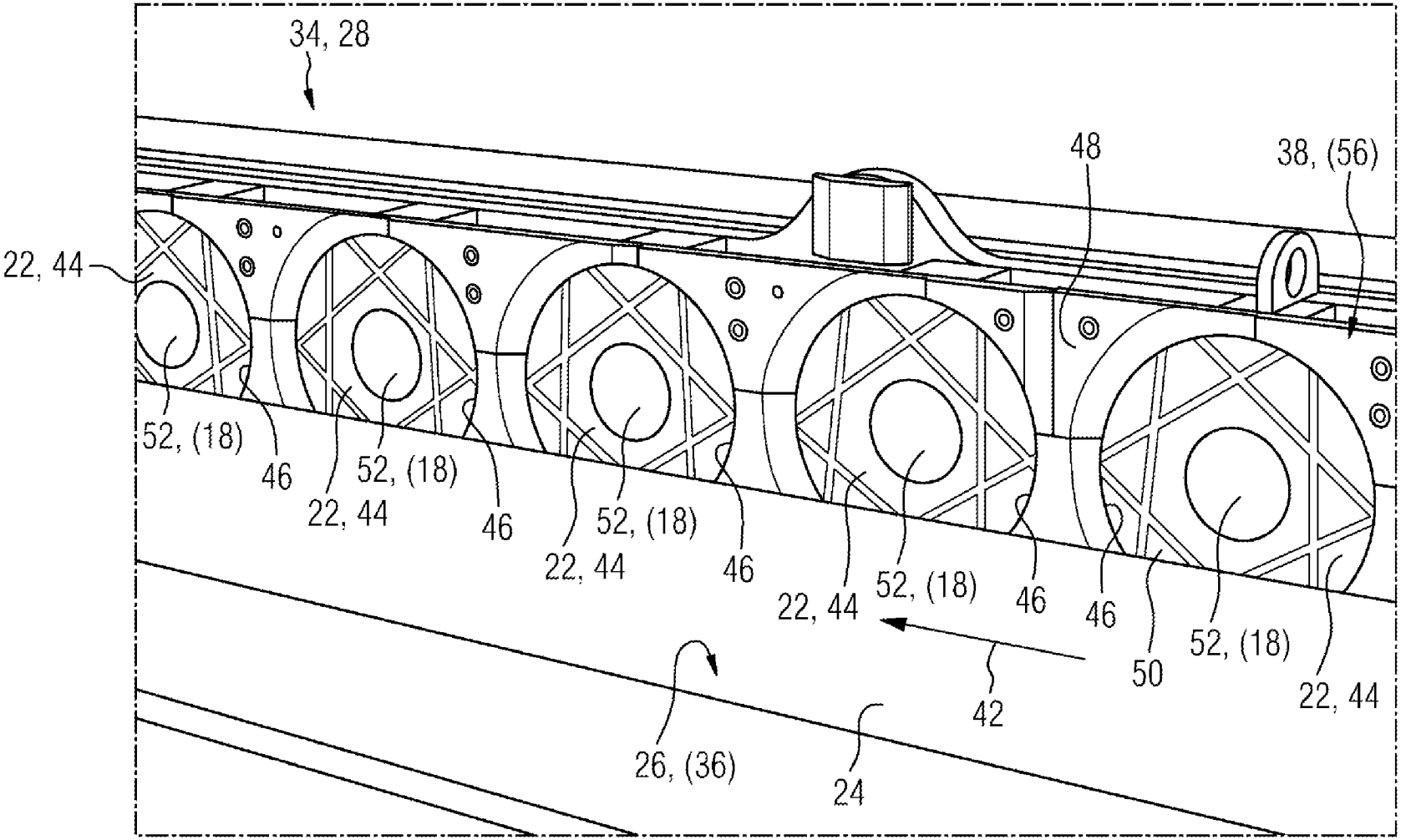
FIG. 1 shows a side guide with rotatable wearing discs (Eco Slide Disc) at a coiler inlet in a hot strip mill.

FIG. 1 shows a part of a side guide 38 or a guide rule/gib 38 at a coiler inlet 34 of a coiler device in a hot strip mill 28.

The hot strip 24 is supplied to a coiler in the transport direction 42 over a substantially horizontally oriented roller table 26 at the coiler inlet 34.

As FIG. 1 shows, in the side guide 38 or guide rule/gib 38 of the coiler inlet 34, referred to below in brief as the coiler gib 34, several wearing elements 22 in the form of rotatable round wearing discs 22 which are arranged in a row along the roller table/portion 26 of the coiler inlet 34, the respective end/base face 44 of which, visible in FIG. 1 forms the wearing face 44 of the respective wearing element 22 or wearing disc 22.

The wearing discs 22, as also shown in FIG. 1, are arranged vertically in respective largely round recesses 46 of the coiler gib 38, and approximately parallel to/with the coiler gib 38 or parallel to its side face 48 facing the roller table 26.

Thus along the coiler gib 38, an approximately flat, Depending on wear state, vertically oriented guide plane 50 is provided at the coiler gib 38 for the hot strip 24 transported on the roller table/portion 26 and to be guided; the roller table/portion 26 is oriented substantially horizontally, perpendicularly thereto.

The substantially vertically oriented parallel to the guide plane 50 wearing discs 22 each have a central rotational axis 52, and about that axis 52, the respective wearing disc 22 is rotatable under control by means of a worm gear 18 into defined rotational Positions (see FIG. 2), whereby it is also guaranteed that the guide plane 50 is retained in all rotational positions of the wearing discs 22.

The hot strip 24 transported horizontally over rolls 36 of the roller table 26 can thus always be securely laterally guided by means of these wearing discs.

Figure 2:
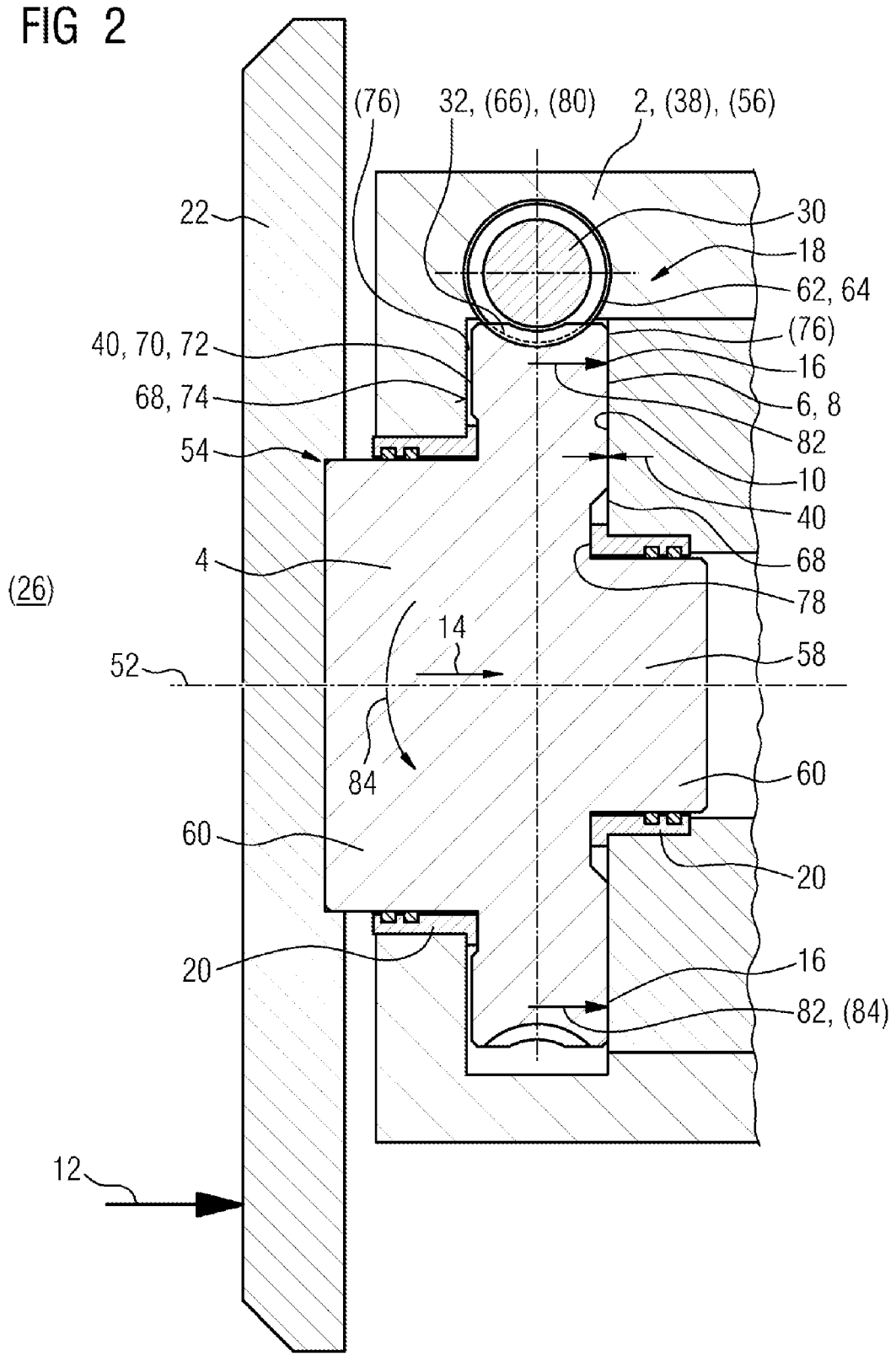
FIG. 2 shows a worm gear for actuation/rotation of a wearing disc (Eco Slide Disc).

FIG. 2 shows in detail the arrangement of a rotatable wearing disc 22 in the coiler gib 38, as an example of one of the several wearing discs 22 which are rotatable by means of the worm gear 18 of the coiler gib 38.

As FIG. 2 shows, the wearing disc 22 sits, centered via a centering seat 54, on a worm wheel 4 of "its worm gear" 18; wherein the worm wheel 4 is received/mounted in a worm housing 2 which is itself part of a gear beam 56, again forming part of the coiler gib 38.

For mounting of the worm wheel 4, a shaft 58 is integrated in and integral with the worm wheel 4. The shaft 58 or worm wheel 4 is mounted in the worm housing 2 or gear beam 56 by means of two bearing bushes 20 sitting on shaft extensions 60.

On the outer periphery 62 of the worm wheel 4, there is the toothing 64 which is in engagement 32 with the worm 30 or its toothing 66.

By means of such a worm gear 18 or this worm 30, the worm wheel can thus rotate into defined rotational positions under control.

The worm 30 is here configured as a "long" spindle comprising the worm toothing 66 and arranged substantially parallel to the coiler gib 38, for example oriented extending along its length, wherein it "passes through" the worm housing 2 of the several worm gears 18, thereby standing not only in engagement 32 with the shown worm wheel 4 of the illustrated worm gear 18, but in engagement 32 with several worm wheels 4 arranged in line along the coiler gib 38.

Thus on actuation of the one worm 30, the several worm wheels 4 can be rotated into defined, desired rotational positions in synchrony/simultaneously.

As FIG. 2 further shows, on its end face 8 facing away from the roller table 26, the worm wheel 4 forms a radially external, annular, flat first support face 6 which is oriented perpendicularly to the rotational axis 52 of the worm wheel 4.

Axially opposite 40 this annular support face 6 on the worm wheel 4, a corresponding second support face 10, oriented parallel therewith, is formed on the worm housing wall 68 of the worm housing 2.

At its end face 70 facing the roller table 22, the worm wheel 4 forms a further end face 72, which in this case for example is flat and is oriented perpendicularly to the rotational axis 52 of the worm wheel 4, and opposite which is a corresponding further worm housing wall/face 72 oriented parallel therewith.

The worm wheel 4 is then received in the worm housing 2, with its first end-side support face 6 firstly and its further support face 72 secondly in "pincer-like" engagement between the second support face 10 of the worm housing 2 on one side and the further worm housing wall face 74 on the worm housing 2 on the other—such that a definable axial play 74 is formed in the "pincers" or "in-between".

In other words, the worm wheel 4 is axially shiftable to a defined maximum inside the "pincers" because of the limitation by the second support face 10 of the worm housing 2 here the axial shift 14 of the first support face 6 on the worm wheel 4 is limited and by the further worm housing wall face 74 of the worm housing 2 here the axial shift 14 of the further end face 72 on the worm wheel 4 is limited.

The other plays within the worm gear 18, i.e. the play of the worm wheel mounting 78 and the play 80 of the worm 30/worm wheel 4, are matched precisely to this or are greater.

Accordingly, under axial loads 12 on the wearing disc 22, the axial shiftability 14 of the worm wheel 4 away from the roller table 26 is limited by the axial play 76 of the worm wheel 4 relative to the worm housing 2, which is achieved or permitted in the worm gear 18 as the axial distance between the first end-side support face 6 on the rotary element 4 and the second axially opposite 40 support face 10 on the worm housing 2.

If then, as illustrated in FIG. 2, an eccentric axial load 12 acts on the wearing disc 22 and hence on the worm wheel 4, the worm wheel 4 can or does shift axially 14 away from the roller table 26 until the first support face 6 on the worm wheel 4 contacts 16 the second support face 10 on the worm housing 2, and thus the first support face 6 on the worm wheel 4 and the second support face 10 on the worm housing are in mutual support 16. The worm wheel 4 thus receives an axial support 16 and also a support 16 against tilting.

In other words, the first end-side support face 6 of the worm wheel 4 is supported 16 under axial load 12 and axial shift 14 on the second axially opposite 40 worm housing support face 10.

This direct support of the worm wheel 4 via the support faces 6, 10 in the worm housing 2 relieves the load on the bearing of the worm wheel 4, i.e. the bearing bushes 20.

In particular in the case of loads 12 acting eccentrically on the wearing disc 22 and hence on the worm wheel 4, as FIG. 2, shows both the axial force 82 and tilt moment 84, which lead not only to axial load 82 but also to tilt moments 84 in the worm wheel 4. In the worm gear 18, the bearing forces and/or bearing moments on the bearing bushes 20 are limited or reduced, i.e., the force is received/absorbed/dissipated through the direct support face contact 16.

Although the invention has been illustrated and described in detail by the preferred exemplary embodiment(s), the invention is not restricted by the disclosed example(s) and other variations may be derived therefrom without leaving the scope of protection of the invention.

LIST OF REFERENCE SIGNS

2 Housing, worm housing
4 Rotary element, gear wheel, worm wheel
6 First support face
8 End face
10 Second support face
12 Axial force/load
14 Axial shiftability/shift
16 Support, support contact
18 (Worm) gear
20 Bearing bush
22 Wear element, wearing disc
24 Rolled product, metal strip, hot strip
26 Roller table/portion
28 Rolling mill, hot strip mill
30 Adjustment means, worm
32 Force-fit connection, (toothed) engagement
34 Coiler inlet
36 Rolls
38 Lateral guidance, side guide, guide rule, (coiler) gib
40 Axially opposite
42 Transport direction
44 End/base face, wearing face
46 Recess

48 Side face
50 Guide plane
52 Rotational axis
54 Centering seat
56 Gear beam
58 Shaft
60 Shaft extension
62 Outer periphery
64 Toothing (worm wheel)
66 Toothing (worm)
68 Worm housing wall
70 End face
72 Further end face
74 Further worm housing wall/face
76 Axial play
78 Play of worm wheel mounting
80 Play of worm/worm wheel or tooth engagement
82 Axial force, axial load
84 Tilt moment

The invention claimed is:

1. A device comprising a housing and a rotary element mounted in the housing such that the rotary element can be rotated and axially shifted;

at least one first support face on an end face of the rotary element and a second support face axially opposite the first support face on the housing;

wherein the rotary element is mounted in the housing such that, under the effect of an axial force on the rotary element, the axial shiftability of the rotary element is limited by the contact of the first support face on the second support face;

a wearing element for lateral guidance of a metal strip is arranged on the rotary element and wherein the rotary element is connected to a gear mechanism, and/or is a component of a gear wheel of a mechanical gear, and/or is a gear wheel of a mechanical gear.

2. The device as claimed in claim 1, further comprising the mechanical gear is a form-fit or force-fit or friction-fit or electrical gear.

3. The device as claimed in claim 1, wherein the rotary element is a worm wheel.

4. The device as claimed in claim 1, wherein the rotary element is mounted in the housing by means of at least one bearing bush.

5. The device as claimed in claim 1, wherein the wearing element is a wearing disc which is arranged on the rotary element.

6. The device as claimed in claim 5, wherein the wearing element is fixed to the rotary element.

7. The device as claimed in claim 5, wherein the wearing element is formed integrally with the rotary element.

8. The device as claimed in claim 1, wherein the first support face is formed to be substantially annular or substantially circular.

9. The device as claimed in claim 1, wherein the rotary element is mounted in the housing such that a planar contact is formed between the first support face and the second support face.

10. An apparatus for lateral guidance of a metal strip for a roller table portion in a rolling mill, comprising at least one device claimed in claim 1.

11. The apparatus for lateral guidance of the metal strip as claimed in claim 10, further comprising a gear beam on which the at least one device is attached.

12. The apparatus for lateral guidance of the metal strip as claimed in claim 10 further comprising adjustment means which is at least in force-fit connection with the rotary element, whereby on actuation of the adjustment means, the rotary element, is rotatable simultaneously and/or in synchrony.

13. The apparatus for lateral guidance of the metal strip as claimed in claim 12, wherein the adjustment means comprises a worm and the rotary element comprises a worm wheel.

14. A roller table portion for a rolling mill at a coiler inlet in a hot strip mill, the roller table portion comprising rolls for transporting a rolled product, and an apparatus for lateral guidance of the rolled product transported by the rolls, the apparatus for lateral guidance of the rolled product comprising a device that includes:

a housing and a rotary element mounted in the housing such that the rotary element can be rotated and axially shifted, at least one first support face on an end face of the rotary element and a second support face axially opposite the first support face on the housing, wherein the rotary element is mounted in the housing such that, under the effect of an axial force on the rotary element, the axial shiftability of the rotary element is limited by the contact of the first support face on the second support face, a wearing element for lateral guidance of a metal strip is arranged on the rotary element and wherein the rotary element is connected to a gear mechanism, and/or is a component of a gear wheel of a mechanical gear, and/or is a gear wheel of a mechanical gear.

* * * * *